US006131654A

United States Patent [19]

Holscher

[11] Patent Number: 6,131,654

[45] Date of Patent: Oct. 17, 2000

[54] WELL COVER AND METHOD OF MAKING

[76] Inventor: Morris Holscher, 12422 State Rte. 362, Minster, Ohio 45865

[21] Appl. No.: 09/126,048

[22] Filed: Jul. 30, 1998

Related U.S. Application Data

[60] Provisional application No. 60/057,913, Sep. 4, 1997.

[51] Int. Cl.[7] ..... E21B 33/00

[52] U.S. Cl. ..... 166/79.1; 428/15; 52/102; 52/103; 47/33; 405/303

[58] Field of Search ..... 166/75.13, 79.1, 166/92.1, 94.1; 405/211, 212, 216; 52/102, 103; 428/34.1, 15; 47/33

[56] References Cited

U.S. PATENT DOCUMENTS

| | | | |
|---|---|---|---|
| 4,021,131 | 5/1977 | Bakken et al. | 52/103 |
| 4,220,421 | 9/1980 | Thorne | 405/211 |
| 4,967,522 | 11/1990 | Keen | 47/33 |
| 5,443,774 | 8/1995 | Kluh et al. | 428/15 |
| 5,478,165 | 12/1995 | Correia et al. | 52/102 |
| 5,543,100 | 8/1996 | Kluh et al. | 428/15 |
| 5,640,801 | 6/1997 | Rynberk | 47/33 |
| 5,685,343 | 11/1997 | Smith | 166/94.1 |
| 5,782,584 | 7/1998 | Arthur | 405/303 |

OTHER PUBLICATIONS

Sales brochure for DFW "Rock Star," Plastic Rock Box, Model DFW–LRB by DFW Rotec, Inc., Bedford, Texas (date unknown).

*Primary Examiner*—Lanna Mai
*Assistant Examiner*—Elaine Gort
*Attorney, Agent, or Firm*—Biebel & French

[57] ABSTRACT

A well cover includes a housing having a top side and a substantially concave bottom side, and a peripheral base portion. A substantially radially outwardly extending flange is disposed on the peripheral base portion for securing the well cover to the ground. Alternatively, a plurality of tabs may be provided for securing the well cover to the ground. The flange or tabs may be provided with holes or slots therethrough. Attachment anchors cooperate with the flange or tabs to releasably secure the well cover to the ground. A method of forming the well cover includes vacuum molding a sheet of vacuum-moldable material into a desired contour. The flange or tabs are formed integrally with the housing.

8 Claims, 5 Drawing Sheets

WELL COVER AND METHOD OF MAKING

CROSS-REFERENCE TO RELATED APPLICATIONS

This application claims the benefit of U.S. Provisional Application No. 60/057,913, filed Sep. 4, 1997.

BACKGROUND OF THE INVENTION

1. Field of the Invention

The present invention relates generally to well covers for covering wells and, more particularly, to a removable well cover having attachment means disposed about its base for securing the well cover to the ground.

2. Description of the Prior Art

Many homes and businesses receive their water supply from wells. Often times the location and height of a well is determined by county or township codes. For example, wells are often required to be at least fifty feet from sewage beds, leech fields, and outhouses, as well as ten feet from property lines. In some circumstances, particularly where lot sizes are limited, this can result in a well being inconveniently placed. For example, a well may be required to be situated in a front yard where it is visible from an adjoining road or other adjoining properties.

In addition, well pipes often consist of PVC or aluminum pipe, frequently 6" to 8" in diameter, and are frequently required by local codes to extend a minimum distance above ground of 24" to 28" in height. Usually, the well pipe is capped with an aluminum or plastic cap. The resulting well and its placement present an aesthetically undesirable appearance and detract from the appearance and enjoyment of the adjacent home or business.

In an effort to provide an aesthetically pleasing appearance, attempts have been made to hide or disguise wells by means of well covers. For example, wells have been covered with well covers designed to look like a Dutch windmill, a wishing well, or a natural rock. However, a well owner must still have access to the well for periodic servicing or as required.

Wooden wells made to resemble wishing wells or Dutch windmills are susceptible to rot and insects. Moreover, they can be overturned, pulled from the well pipe, or even be torn apart by high winds.

Accordingly, there continues to exist a need for a well cover including attachment means for securing the cover to the ground, and which may be positioned over a well and easily removed for servicing the well.

SUMMARY OF THE INVENTION

The present invention provides a well cover for use in covering a well wherein the well includes a housing defining an upper contoured surface, a substantially concave under surface, a peripheral base portion located between the upper and under sides, and attachment means disposed on said peripheral base portion.

Attachment anchors are provided adjacent the attachment means and are adapted to cooperate with the attachment means to secure the well cover to the ground. The attachment means may take the form of a flange having a plurality of holes or slots therein, or a plurality of flanges or tabs each having a hole or slot therein. The attachment anchors may take the form of stakes or rods adapted to be driven through the holes or slots in the attachment means a sufficient depth into the ground to securely anchor the well cover to the ground. The anchors may be provided with heads or handles for facilitating insertion into and removal from the ground.

Therefore, it is an object of the present invention to provide a well cover including a housing having attachment means for releasably securing the cover to the ground.

It is another object of the invention to provide a well cover that is esthetically pleasing, lightweight, and durable.

Other objects and advantages of the invention will be apparent from he following description, the accompanying drawings and the appended claims.

DETAILED DESCRIPTION OF THE PREFERRED EMBODIMENT

Figure 1:
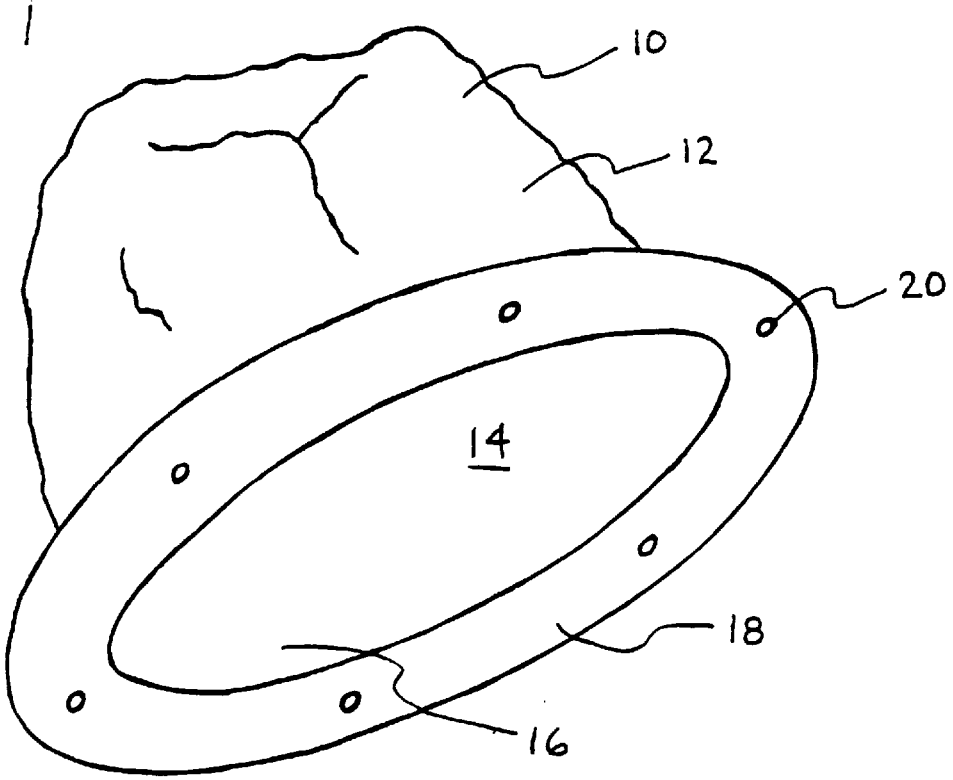
FIG. 1 is a perspective view of the well cover of the present invention as viewed from below the well cover.
Figure 2:
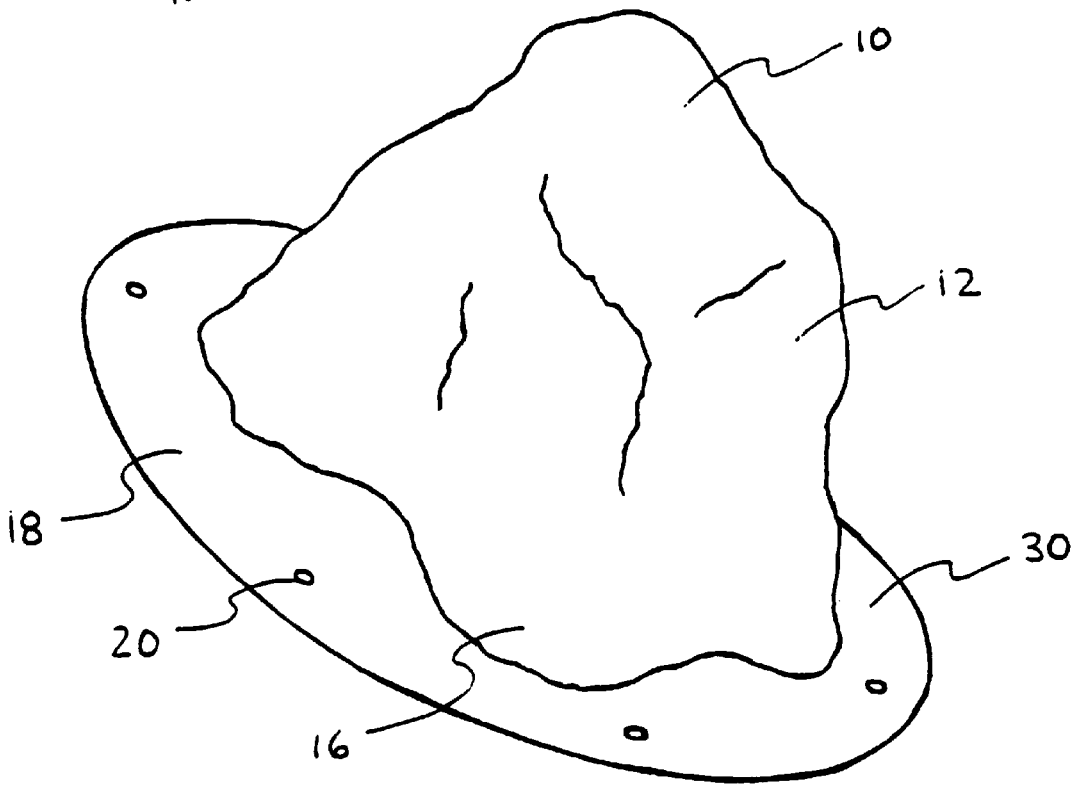
FIG. 2 is a perspective view of the well cover and a first embodiment of the attachment means, as viewed from above the well cover.
Figure 3:
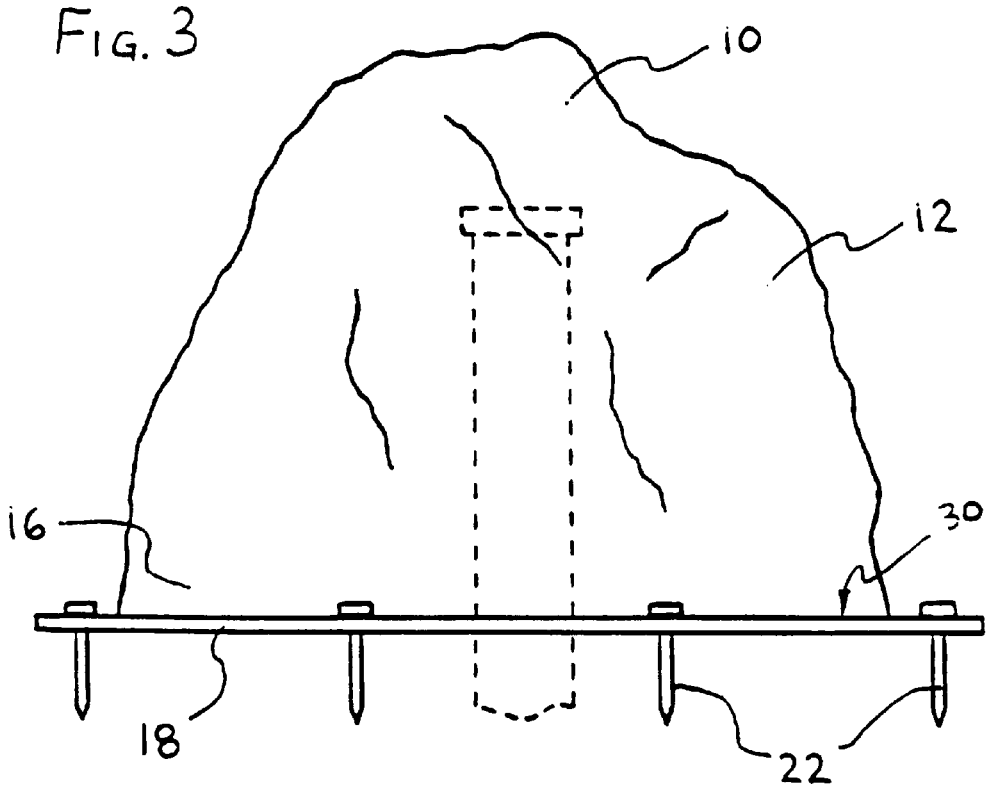
FIG. 3 is a front elevational view of the well cover positioned over a well pipe.

Referring to FIGS. 1–3, the well cover of the present invention includes a housing 10 having a top side 12, a bottom side 14, a peripheral base portion 16, and attachment means or flange 18 disposed on the peripheral base portion 16. The attachment means 18 is provided with a plurality of holes 20. A plurality of stakes or attachment anchors 22 are provided and are adapted to cooperate with the holes 20 and an upper surface 30 of the flange 18 to releasably secure the well cover 10 to the ground. Preferably, the attachment means 18 is formed integrally with the housing 10, but may be formed separately and attached to the housing 10, as desired. Alternatively, the attachment means 18 may be provided with slots or notches to receive the attachment anchors 22.

The housing 10 is preferably formed of molded high-density polyethylene. However, the housing 10 may be molded of any suitable material including, without limitation, acrylonitrile-butadiene-styrene, polyvinyl chloride, polypropylene, and thermoplastic olefins. Preferably the housing 10 is molded to resemble a natural rock, and is sized to fit over wells having a well pipe of at least 28 inches in height and 8 inches in diameter. Thus, the well cover comes in a "one-size-fits-all" configuration. However, any suitable exterior appearance may be imparted to the well cover 10 depending on user requirements.

The housing 10 has a non-symmetric appearance so that it will not look the same when viewed from different perspectives. However, the well cover may be made to have a symmetrical appearance if desired. The housing 10 may also have one or more substantially flat surfaces, if desired, upon which may be placed a name, a house number, or other desired symbol or mark. The housing 10 may come in a variety of colors of which slate gray, brown, and rust may be mentioned. The colors are molded into the housing 10 so as to be disposed throughout the material. However, colors, tints, lacquers, decals, or other coverings may be applied to the exterior as desired. Preferably, the material from which the housing 10 is molded contains an ultraviolet protectant for protecting the well cover from fading, deterioration, or other damage due to exposure to the sun.

While not required, the housing 10 could be equipped with holes or openings for ventilating the interior of the housing 10 to the outside air. Such ventilation may be desired where, for example, natural gas may accumulate around or near the well pipe. Also, the well cover may have disposed on its bottom side 14 insulation means for insulating the well pipe. Such insulating means may take the form of a glass fiber blanket or rigid polyurethane foam, for example. The insulated well cover would act to retain ground heat about the well pipe so as to maintain the temperature of the well pipe above that for a similarly situated well pipe without a well cover during the winter months.

Figure 4:
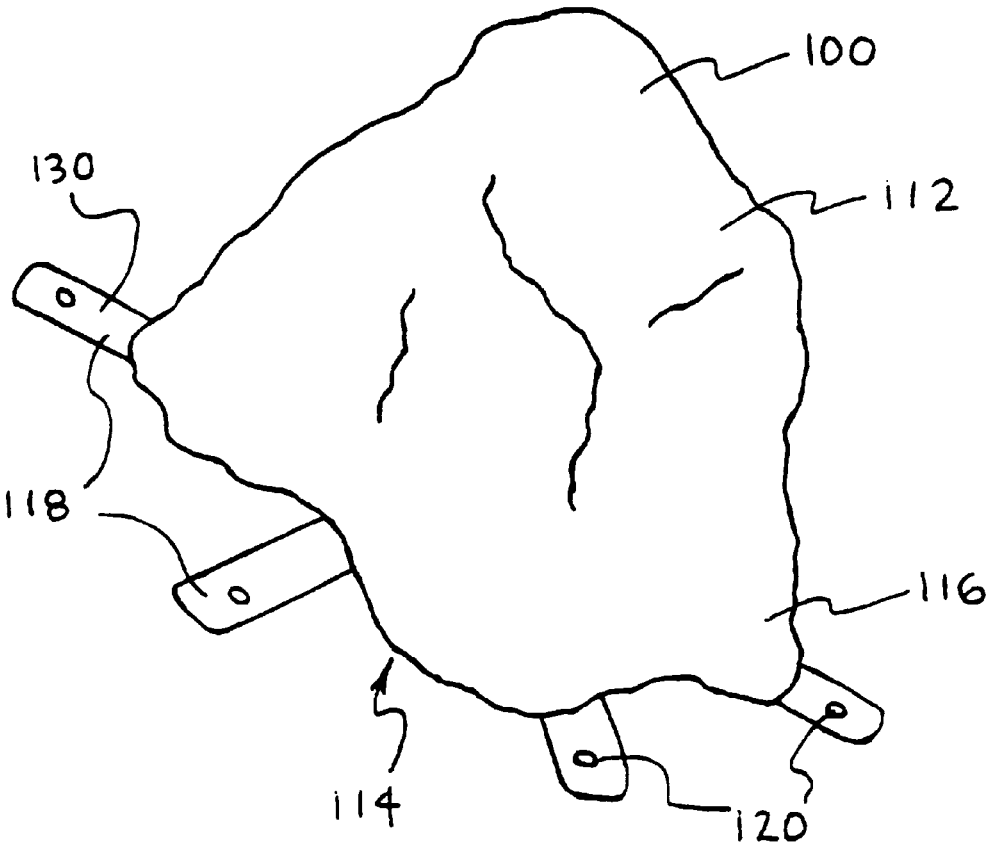
FIG. 4 is a perspective view of the well cover and a second embodiment of the attachment means.

Turning now to FIG. 4, a second embodiment of the well cover is shown. The second embodiment includes a housing 100 including a top side 112, a substantially concave bottom side 114, a peripheral base portion 116, and substantially radially outwardly extending attachment means 118 disposed on the peripheral base portion 116. The attachment means 118 includes a plurality of holes 120, or slots (not shown), and an upper surface 130.

Figure 5:
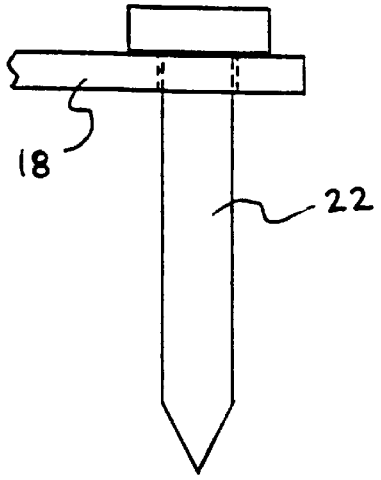
FIG. 5 is an enlarged elevational view of a first embodiment of an attachment anchor for the well cover.
Figure 6:
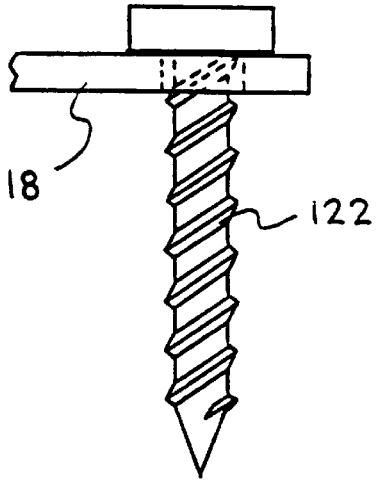
FIG. 6 is an enlarged elevational view of a second embodiment of an attachment anchor for the well cover.

The attachment means 118 in the second embodiment 100 take the form of tabs or feet 118. As before, attachment anchors 22, shown in FIGS. 3 and 5, are adapted to cooperate with the attachment means 118 to secure the well cover 100 to the ground. The attachment anchors 22 preferably take the form of rods or stakes. The anchors 22 are at least 6 inches to 8 inches in length, but may be of any length sufficient to secure the well cover to the ground. The anchors 22 may be provided with broad flat heads, or handles to assist in inserting the anchors 22 into the ground and removing the anchors 22 from the ground. Alternatively, a second embodiment of the anchors is shown in FIG. 6. The second embodiment of the anchor 122 may take the form of a large screw or auger or threaded rod. The alternative anchor 122 may likewise have a broad flat head, or a handle (not shown) to aid in securing the anchor 122 in the ground and removing the anchor 122 from the ground.

Figure 7:
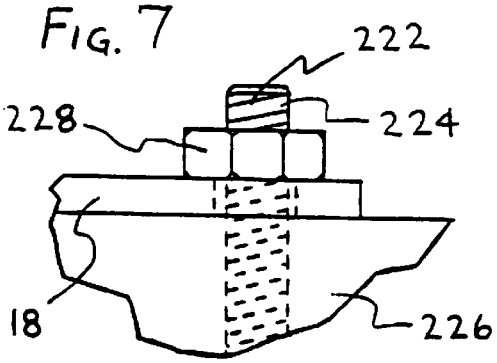
FIG. 7 is an enlarged elevational view of a third embodiment of an attachment anchor for the well cover.

Referring now to FIG. 7, there is shown a third embodiment 222 of the attachment anchors. The anchors 222 comprise a plurality of threaded rods or bolts 224 embedded in stone or concrete 226 set in the ground adjacent a well pipe (not shown), and a plurality of threaded fasteners or nuts 228. The bolts 224 are located so as to align with the plurality of holes 20, 120 (or slots) in the attachment means 18, 118 of the well cover 10, 100. As shown by this embodiment, the well cover may be releasably secured to generally planar mounting surfaces or foundations.

Figure 8:
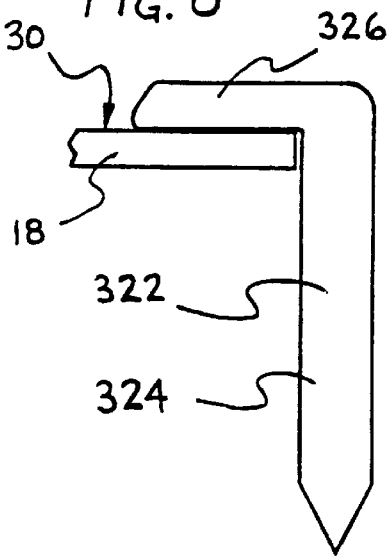
FIG. 8 is an enlarged elevational view of a fourth embodiment of an attachment anchor for the well cover.

Referring now to FIG. 8, there is shown yet a fourth embodiment 322 of the attachment anchors. The anchors 322 comprise L-shaped stakes or rods 324 having a head 326, such that the head 326 and the rod 324 are disposed substantially at a right angle to each other. The anchors 322 may be inserted through holes 20 or 120 to secure the well cover 10 or 100 to the ground. Alternatively, the anchors 322 may be inserted into the ground adjacent the attachment means 18 or 118 such that the head 326 bears downwardly on, or exerts a force on, an upper surface 30 of the attachment means 18 or 118 to hold the well cover 10 or 100 securely to the ground.

One method of making the well cover of the present invention comprises the steps of providing a sheet of suitable plastic material, such as a deformable or vacuum-moldable material, providing a vacuum mold having a desired contour, heating the sheet until it is deformable, placing the sheet over the mold, drawing a vacuum on the sheet to cause the sheet to conform to the desired contour, and allowing the deformed plastic sheet to set. After the formed sheet has set, the air pressure on it is reversed to release the vacuum. Any excess material on the sheet may be removed. If ventilating openings are desired, they may be formed in the well cover. Likewise, any insulating means could be affixed to the bottom side of the well cover at this time. In addition, any desired exterior appearance may be imparted to the molded well cover at this time.

While vacuum forming the well cover is the preferred method for making the well cover, the well cover could be made by any suitable process such as, for example, injection molding. Also, while the well cover has been described as being molded out of plastic, it should be recognized that the well cover could be made out of metal, cement, porcelain, rubber, or wood by methods appropriate to those materials, as desired. Moreover, while the preferred form for the well cover is as a natural rock, it should be appreciated that the well cover could take on a nearly endless variety of forms, limited only be the type of material and manufacturing process used.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A well cover comprising:

a housing including a contoured top side, a substantially concave bottom side, and a peripheral base portion; and attachment means disposed on said peripheral base portion wherein said attachment means comprises a flange disposed at a lower edge of said peripheral base portion and extending radially outwardly therefrom, and said attachment means further comprises stakes engaged with and extending downwardly from said flange, to secure the well cover to the ground.

2. The well cover as recited in claim 1 wherein said contoured top side is adapted to resemble a natural rock.

3. The well cover as recited in claim 1 wherein said flange comprises a plurality of holes therethrough for receiving said stakes.

4. The well cover as recited in claim 1 wherein said stakes each include a head and a rod, said head and said rod disposed substantially at right angles to each other, wherein said rod is adapted to be disposed in the ground, and said head is adapted to be disposed on an upper surface of said flange to secure said well cover to the ground.

5. The well cover as recited in claim 1 wherein said flange is formed integrally with said housing.

6. The well cover as recited in claim 1 wherein said housing further comprises molded plastic material.

7. The well cover as recited in claim 6 wherein said molded plastic material comprises high density polyethylene.

8. A well cover comprising:

a housing including a contoured top side, a substantially concave bottom side, and a peripheral base portion; and attachment means disposed on said peripheral base portion wherein said attachment means comprises a plurality of tabs disposed on said peripheral base portion and extending radially outwardly therefrom, and said attachment means further comprises stakes adapted to cooperate with said tabs to secure the well cover to the ground, wherein said tabs each comprise a hole therethrough for receiving said stakes.

* * * * *